US006182746B1

(12) United States Patent
Wiese

(10) Patent No.: US 6,182,746 B1
(45) Date of Patent: Feb. 6, 2001

(54) PLATE-TYPE HEAT EXCHANGER

(75) Inventor: Manfred Wiese, Gerlingen (DE)

(73) Assignee: Behr GmbH & Co., Stuttgart (DE)

( * ) Notice: Under 35 U.S.C. 154(b), the term of this patent shall be extended for 0 days.

(21) Appl. No.: 09/192,318

(22) Filed: Nov. 16, 1998

(30) Foreign Application Priority Data

Nov. 17, 1997 (DE) ..... 197 50 748

(51) Int. Cl.[7] ..... F28D 9/00; F28F 3/08
(52) U.S. Cl. ..... 165/166; 165/167; 228/183
(58) Field of Search ..... 165/166, 167; 228/183

(56) References Cited

U.S. PATENT DOCUMENTS

| | | | | |
|---|---|---|---|---|
| 5,291,945 | * | 3/1994 | Blomgren et al. | 165/167 |
| 5,462,113 | * | 10/1995 | Wand | 165/167 |
| 5,924,484 | * | 7/1999 | Andersson et al. | 165/167 |
| 5,931,219 | * | 8/1999 | Kull et al. | 165/51 |

FOREIGN PATENT DOCUMENTS

| | | |
|---|---|---|
| 9309741 | 10/1993 | (DE) . |
| 19517174C1 | 6/1996 | (DE) . |
| 0258236B1 | 10/1990 | (EP) . |
| 0551545A1 | 7/1993 | (EP) . |
| 0611941A2 | 8/1994 | (EP) . |
| 0623798A2 | 11/1994 | (EP) . |
| 0742418A2 | 11/1996 | (EP) . |
| WO 91/17404 | 11/1991 | (WO) . |
| WO 92/11501 | 7/1992 | (WO) . |
| WO 97/15797 | 5/1997 | (WO) . |

* cited by examiner

*Primary Examiner*—Allen Flanigan
(74) *Attorney, Agent, or Firm*—Jones, Tullar & Cooper, P.C.

(57) ABSTRACT

In connection with a plate-type heat exchanger having several stacked, tub-shaped heat exchanger plates, each with a circumferential, beveled border, the borders of these heat exchanger plates being embodied to be curved and bent outward. This results in improved brazing of the heat exchanger plates with each other.

11 Claims, 3 Drawing Sheets

PLATE-TYPE HEAT EXCHANGER

FIELD OF THE INVENTION

The present invention relates to a plate-type heat exchanger, in particular an oil-coolant cooler for internal combustion engines, having several stacked tub-shaped heat exchanger plates, which have a plate bottom and a circumferential, beveled border and are provided with passages for the fluids, wherein the circumferential border of one heat exchanger plate rests against the circumferential border of the adjoining heat exchanger plate and is connected with it by material contact, in particular by brazing, and the plate bottom makes a transition without a step into the border.

BACKGROUND OF THE INVENTION

Such a plate-type heat exchanger is known, for example, from European Patent Publication EP 0 623 798 A1. This heat exchanger has a plurality of heat exchanger plates which are stacked on top of each other, so that their borders overlap at least partially. The individual heat exchanger plates are connected with each other in that the plate packages are soldered together in a vacuum furnace. In the process, the brazing material of the plated heat exchanger plates is melted, but the creation of embedded oxides cannot be ruled out. Furthermore, large overlapping areas in general have the disadvantage of having long degassing paths, so that gas could possibly be embedded during brazing. Large overlapping areas have the further disadvantage that component tolerances have a disadvantageous effect on the gap conditions, since possibly the optimal contact between the borders is no longer assured.

A plate-type heat exchanger is known from European Patent Publication EP 0 742 418 A2, in connection with which it has been attempted to overcome these disadvantages in that the plate bottom makes a transition via a shoulder into the border. If the individual heat exchanger plates are stacked on top of each other, the plate bottom of one heat exchanger plate rests on the shoulder of the adjoining lower heat exchanger plate, so that in this way overlapping areas are created, which have a relatively small surface, or respectively short degassing paths. The border adjoining the shoulder and projecting toward the outside is not important when brazing the individual heat exchanger plates together.

A plate-type heat exchanger is known from European Patent Publications EP 0 258 236 B1 and EP 0 551 545 A1, wherein the heat exchanger plates have a border which is alternatingly beveled several times, so that it has shoulder-like contact faces. As in European Patent Publication EP 0 742 418 A2, the plate bottoms of the adjoining heat exchanger plates are placed on these shoulders, so that a definite contact between two adjoining heat exchanger plates is assured.

OBJECT AND SUMMARY OF THE INVENTION

Based on European Patent Publication EP 0 623 798 A2, it is the object of present invention to make a plate-type heat exchanger available, which has a relatively simple structure and wherein the danger of incorrect brazed spots is reduced, and wherein tolerances of the heat exchanger plates have less serious consequences.

This object is attained in accordance with the present invention in that the border has a continuous or discontinuous curvature and, starting at the heat exchanger plate, the curvature is directed obliquely outward and always points in only one direction.

Thus, the plate-type heat exchanger in accordance with the present invention has heat exchanger plates having a border which adjoins the plate bottom without a shoulder and which is not level, but curved. In this case the curvature always extends in one direction, namely from the inside to the outside, so that the heat exchanger plate is opened. An advantage is achieved by means of the outwardly curved border, in that the overlapping areas of adjoining borders are relatively short, so that during brazing the pressure forces have a stronger effect than with large overlapping areas. The degassing paths are shortened because of this reduced joint gap, and because of the increased joining forces, larger frictional forces are created during the brazing process so that, for one, the brazing material is better displaced, and for another, oxide layers are better torn open. A further advantage is seen to reside in the fact that, because of the curved border, the entire heat exchanger plate per se has increased stability, and component tolerances, deviations from measurement and joining errors no longer have such a disadvantageous effect on the brazing conditions, since the contact faces between two borders are considerably reduced.

In a further development it has been provided that the transition area from the plate bottom to the border of one heat exchanger plate rests against the inner face of the border of an adjoining heat exchanger plate. The soldered connection is therefore located in the transition area from the plate bottom to the border, so that the forces being generated by the interior pressure in the plate-type heat exchanger can be absorbed considerably better than by brazed connections, which are located at the free end of the border. The plate-type heat exchanger is safer as a whole because of the improved pressure stability.

It is provided by a variant of the present invention that adjoining borders diverge in the direction of their free longitudinal edges. In this way it is possible for the displaced brazing material to escape more easily out of the brazing gap during brazing, and it is collected in the form of a hollow throat in the diverging area.

In accordance with an exemplary embodiment it is provided that in case of a continuously curved border, the radius of curvature is constant. However, continuously curved borders are also conceivable in which the radius of curvature varies, in particular decreases from the plate bottom toward the free longitudinal edge. In this way the gap between two adjoining borders opens continuously.

With a discontinuously curved border, at least one kink line is provided, which extends in the longitudinal direction of the border. Preferably two such kink lines are provided on the border, through which the border is continuously displaced further and further outward. However, the curvature always extends in one direction.

Further advantages, characteristics and details ensue from the following description, in which three particularly preferred exemplary embodiments have been described in detail, making reference to the drawings. In this case the characteristics represented in the drawings and mentioned in the specification as well as in the claims can be essential for the invention respectively individually on their own or in any arbitrary combination.

DETAILED DESCRIPTION OF THE PREFERRED EMBODIMENTS

Figure 1:
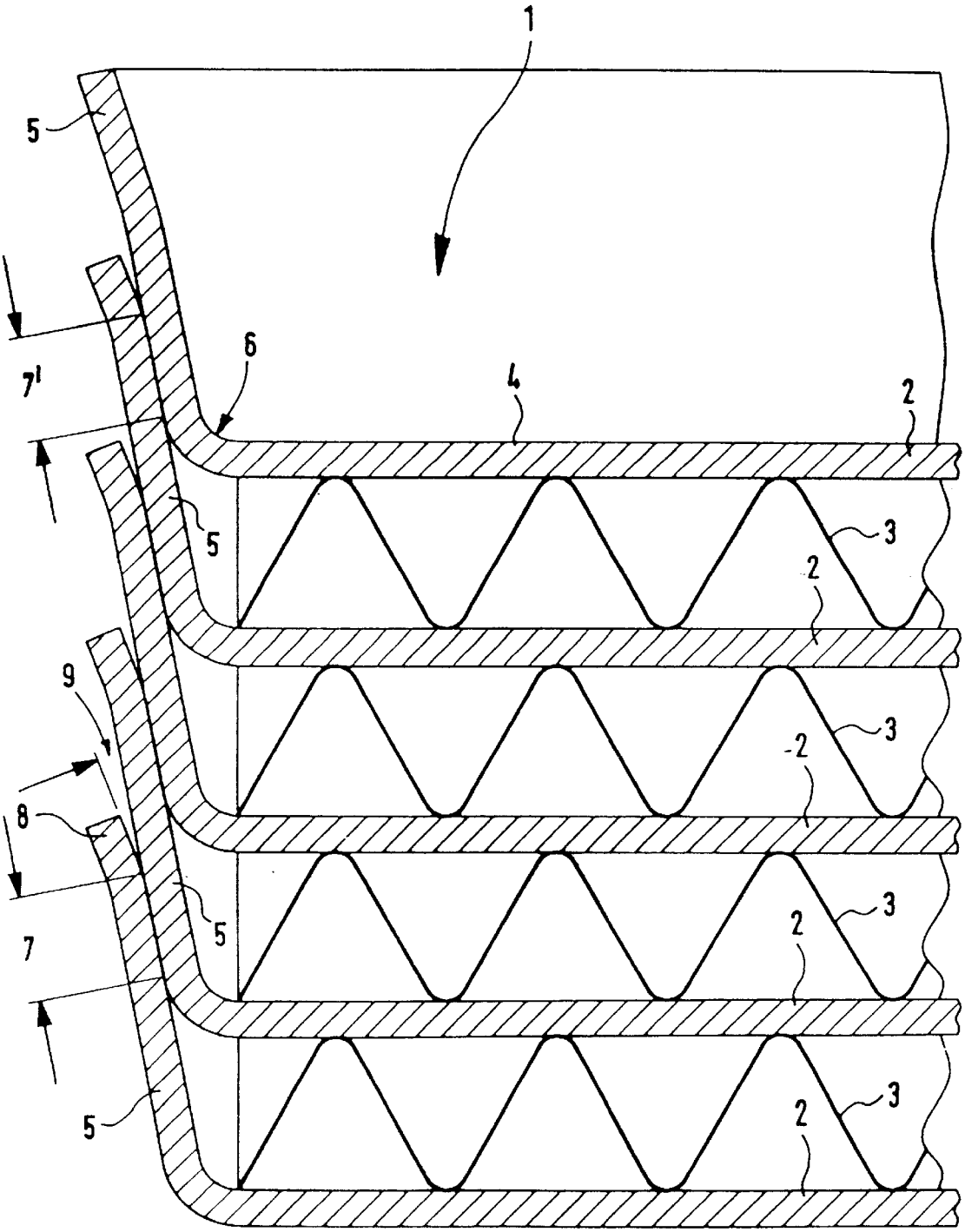
FIG. 1 represents a sectional view through a first embodiment of the plate-type heat exchanger in accordance with the present invention.

FIG. 1 represents a sectional view through a plate-type heat exchanger, identified as a whole by 1, which is only partially shown. Several heat exchanger plates 2, which are stacked on top of each other, can be seen, between which are turbulence inserts 3 (which are only sketched in). The job of these turbulence inserts 3 is to set and assure the distance between two adjoining heat exchanger plates 2, which rest against the turbulence insert 3. The heat exchanger plates 2 have a plate bottom 4 and a circumferential border 5. This border 5 adjoins the plate bottom 4 without a shoulder, i.e. the transition area 6 merely consists of a bevel. It can be also clearly seen that the borders 5 of the two lower heat exchanger plates 2 touch along a border contact face 7, which is followed by a border outlet 8 being at a distance 9 from the adjoining border 5. The border outlet 8 clearly extends outward, i.e. it moves away from the adjoining border 5.

It can furthermore be seen in FIG. 1, that the topmost heat exchanger plate 2 rests canted on the heat exchanger plate 2 underneath it. The border 5 of this topmost heat exchanger plate 2 rests against the border 5 of the heat exchanger plate 2 underneath it along a border contact face 7', wherein the height of the border contact face 7' approximately corresponds to the height of the customary border contact face 7. Furthermore, these border contact faces 7 and 7' are located in the direct vicinity of the transition area 6 of the plate bottom 4 into the border 5. The borders 5 represented in FIG. 1 are continuously curved outward, so that the heat exchanger plates 2 are continuously open toward the top.

Figure 2:
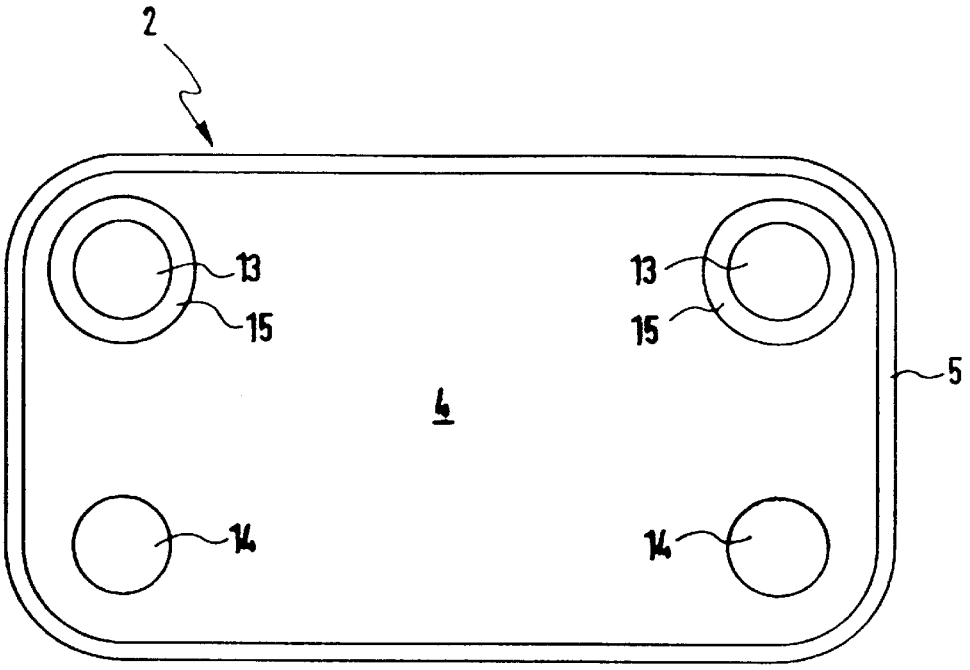
FIG. 2 is a view from above on a heat exchanger plate.

FIG. 2 shows a view from above on a heat exchanger plate 2, and the circumferential border 5 and the passages 13 and 14 for the fluids can be clearly seen. The passages 14 are constituted by circular holes in the plate bottom 4. The passages 13 have an edge 15 which, starting at the plate bottom, extends upward and is then angled in the direction toward the passage 13. This Z-shaped extending edge 15 rests against the underside of the plate bottom 4 of the heat exchanger plate 2 lying above it and is brazed together with it. The heat exchanger plates 2, which are embodied the same, are stacked on top of each other in such a way, that the passages 13 are alternatingly on the one and on the other side. The passage 13 is then aligned with the passage 14 of the adjoining heat exchanger plate 2. In this way an opportunity is provided for guiding the fluid from the one heat exchanger plate 2 to the next but one heat exchanger plate 2, bypassing one heat exchanger plate 2.

Figure 3:
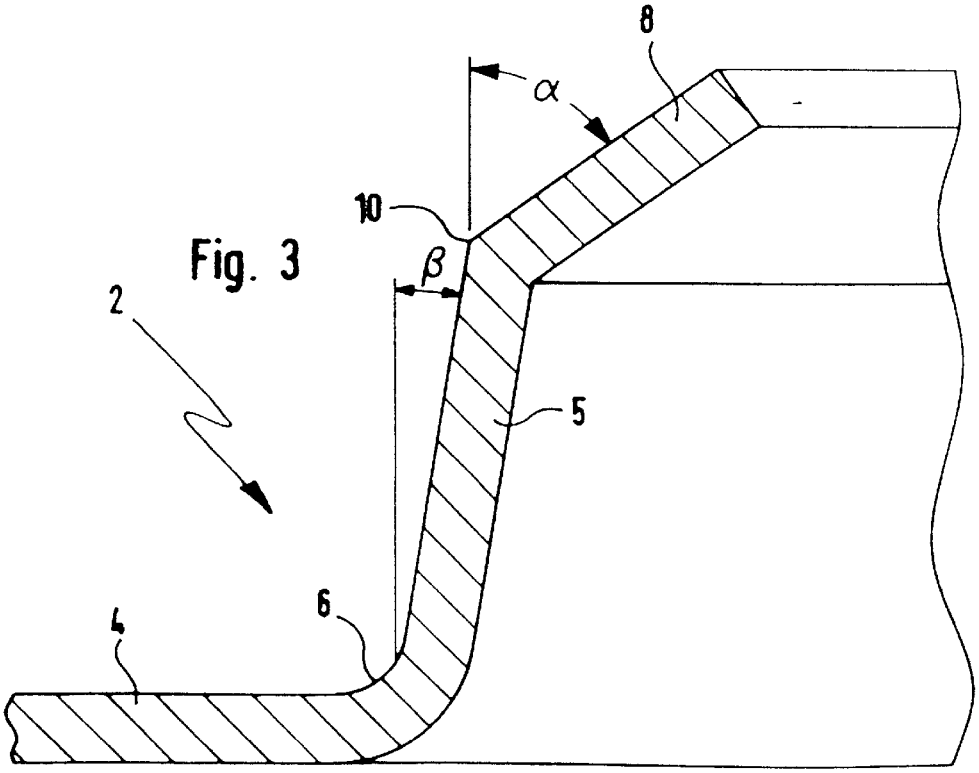
FIG. 3 represents a sectional view through a border of a heat exchanger plate in accordance with a second exemplary embodiment.

FIG. 3 shows a border 5 of another embodiment of a heat exchanger plate 2, which has a kink line 10, so that the border outlet 8 is extended further outward than the remainder of the border 5. The border outlet 8 has an angle $\alpha$ of 35° with respect to a vertical line, while the remainder of the border is inclined at an angle $\beta$ of, for example 9.5° with respect to a vertical line.

Figure 4:
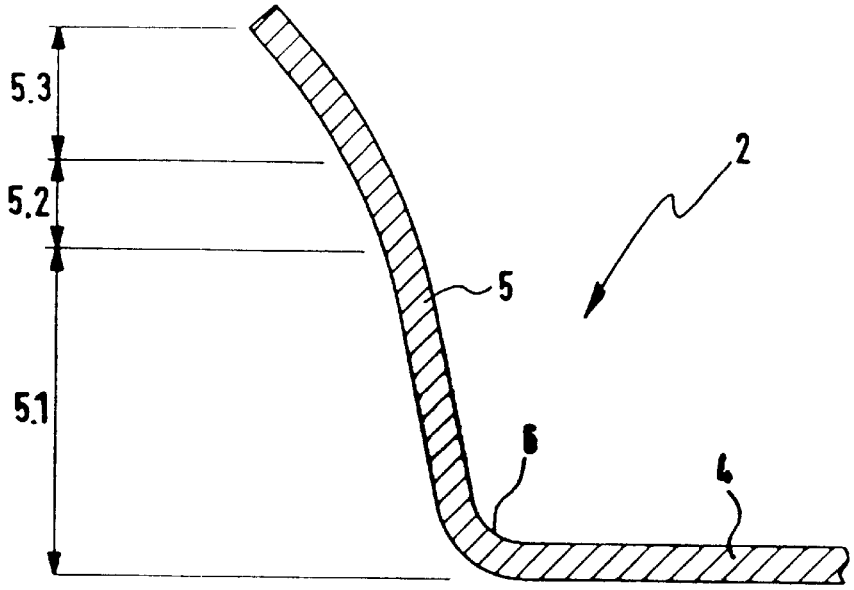
FIG. 4 represents a sectional view through a border of a heat exchanger plate in accordance with a third exemplary embodiment.
Figure 5:
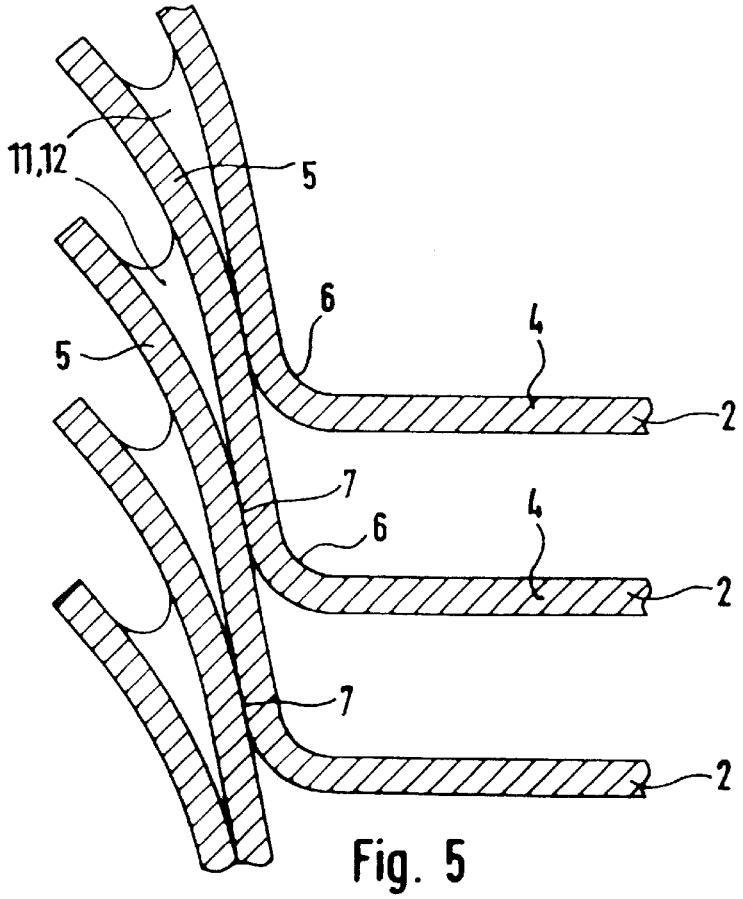
FIG. 5 is a sectional view through several heat exchanger plates in accordance with FIG. 4, stacked on top of each other, which have been brazed together.

In the exemplary embodiment of FIG. 4, the border 5 is formed by three sections 5.1, 5.2 and 5.3. The angles of these sections 5.1, 5.2 and 5.3 with respect to a vertical line are approximately 7.5° for the section 5.1, 12° for the section 5.2 and 33° for the section 5.3. If heat exchanger plates 2 embodied in this way are stacked on top of each other (FIG. 5) and brazed together, a relatively large frictional force is generated in the area of the contact face 7, by means of which oxidation surfaces in the solder are torn open and an optimal brazing is achieved in this way. The brazing material 11 is squeezed out of the brazing material gap and is collected in the form of a hollow throat 12 between two adjoining borders. Such a brazing connection, which lies comparatively close to the transition area 6, can absorb very high forces and provides increased safety in case of high interior pressures.

Plate-type heat exchangers of this type offer a higher process assurance and therefore better quality with little finishing work and a small extra outlay.

What is claimed is:

1. A plate-type heat exchanger, comprising:

at least two stacked tub-shaped heat exchanger plates, each tub-shaped heat exchanger plate having:

a plate bottom;

a circumferential, beveled border; and inlet and outlet passages for fluid passage, wherein said plate bottom of each tub-shaped heat exchanger plate includes a transition, without a step, into its associated circumferential beveled border;

said circumferential, beveled border of each tub-shaped heat exchanger plate has one of a continuous and discontinuous curvature, with the curvature directed outwardly from the tub-shaped heat exchanger plate; and said circumferential, beveled border of adjoining tub-shaped heat exchanger plates having joined surfaces which are connected to each other by brazing along their curvature, such that a brazed fillet is formed between and contacts curved surfaces of facing surface portions of adjacent plates.

2. The plate-type heat exchanger as defined in claim 1, wherein:

a transition area is defined for each tub-shaped heat exchanger plate between each plate bottom and its associated circumferential, beveled border, and said transition area of one tub-shaped heat exchanger plate rests against an interior facing surface of said circumferential, beveled border of the adjoining tub-shaped heat exchanger plate.

3. The plate-type heat exchanger as defined in claim 1, wherein:

each circumferential, beveled border includes a free longitudinal edge; and adjoining circumferential, beveled borders diverge in the direction of their free longitudinal edges.

4. The plate-type heat exchanger as defined in claim 1, wherein:

for continuously curved circumferential, beveled borders, the radius of curvature is constant.

5. The plate-type heat exchanger as defined in claim 1, wherein:

each circumferential, beveled border includes a free longitudinal edge; and for continuously curved circumferential, beveled borders, the radius of curvature various, from its associated plate bottom toward said free longitudinal edge.

6. The plate-type heat exchanger as defined in claim 5, wherein:

the radius of curvature is reduced.

7. The plate-type heat exchanger as defined in claim 1, wherein:

for discontinuously curved circumferential, beveled borders, at least one kink line is provided which extends in the longitudinal direction of said circumferential, beveled border.

8. The plate-type heat exchanger as defined in claim 7, wherein:

two kink lines are provided.

9. The plate-type heat exchanger as defined in claim 1, wherein:

said circumferential, beveled border extends toward the exterior.

10. The plate-type heat exchanger as defined in claim 1, further comprising:

at least one turbulence insert is provided.

11. The plate-type heat exchanger as defined in claim 10, wherein:

said turbulence insert is used as a spacer for adjoining tub-shaped heat exchanger plates.

* * * * *